United States Patent [19]

Smiley et al.

[11] Patent Number: 4,721,052

[45] Date of Patent: Jan. 26, 1988

[54] PEDESTAL WHEEL STEERING SYSTEM HAVING UNIVERSAL SELF-ADJUSTING IDLER

[75] Inventors: Malcolm J. Smiley, Mentor; Bruce Groves, Seven Hills, both of Ohio

[73] Assignee: Merriman/Yacht Specialties, Inc., Grand River, Ohio

[21] Appl. No.: 791,583

[22] Filed: Oct. 25, 1985

[51] Int. Cl.[4] ..... B63H 25/10

[52] U.S. Cl. ..... 114/160; 74/89.22; 114/144 R; 254/415; 254/411; 254/394

[58] Field of Search ..... 114/144 R, 160, 161; 254/415, 411, 394; 74/89.22; 474/63; 248/278; 411/401; 403/78, 164, 165

[56] References Cited

U.S. PATENT DOCUMENTS

| | | | |
|---|---|---|---|
| 1,963,799 | 6/1934 | Nelson | 411/401 X |
| 2,291,894 | 8/1942 | Gwinn, Jr. | 254/415 |
| 3,104,094 | 9/1963 | Liem et al. | 254/415 X |
| 4,040,375 | 8/1977 | Atkins et al. | 114/160 |
| 4,470,363 | 9/1984 | Kalayjian | 114/144 |

*Primary Examiner*—Joseph F. Peters, Jr.

*Assistant Examiner*—Paul E. Salmon

*Attorney, Agent, or Firm*—Reising, Ethington, Barnard, Perry & Milton

[57] ABSTRACT

A boat steering assembly (10) including a pedestal steering actuator (11) in a column (12) mounted on a boat sole (16). A pair of steering cables (18,20) lead from the actuator through a substantially vertical orientation and then through a universal self-adjusting pulley (26) and then in substantially horizontal orientation to a rudder assembly (24). A depending bracket assembly (22) is mounted under the boat sole (16). The universal self-adjusting idler pulley (26) is mounted under the pedestal column (12) below the boat sole (16) by the depending bracket assembly (22). The steering cables (18,20) extend down from the steering actuator (11) and about the pulley assembly (26) with the bracket assembly (22) disposed on the outside of the turn of the cables (18,20) through the pulley (26) to suspend the pulley (26) in tension from the bracket assembly (22). The pulley assembly (26) is adjustable to accommodate various positions of the rudder assembly (24) relative to the pedestal column (12).

8 Claims, 4 Drawing Figures

PEDESTAL WHEEL STEERING SYSTEM HAVING UNIVERSAL SELF-ADJUSTING IDLER

TECHNICAL FIELD

The invention relates generally to pedestal wheel steering systems used on sailboats having idler plates bolted under deck beneath the pedestal.

BACKGROUND OF THE INVENTION

Prior art idler plates commonly employ sheave brackets in compression wherein a sheave bracket mounted on the underside of an idler plate below a deck rigidly supports one of a pair of pulleys each passing a steering cable between a steering actuator assembly and the rudder shaft. Such a design requires the sheave bracket to provide rigid support, in turn, requiring painstaking adjustment during installation to insure proper alignment of the steering cable.

U.S. Pat. Nos. 4,040,375 to Atkins and 4,470,363 to Kalayjian, disclose an installation wherein the steering cables are crossed in the pedestal column and exit therefrom at an angle near 90°, depending on whether the cable travels directly aft or athwartship to the rudder-post. A rigid sheave bracket cannot adjust to accommodate the vertical angle change of the downwardly passing cable. Although a housing assembly may be movable horizontally to accommodate various relative rudder positions, there are still blind spots to which the steering cable cannot be run and installation of the steering cable through the sheave bracket assembly still requires painstaking adjustment to ensure proper alignment of the steering cable.

SUMMARY OF INVENTION AND ADVANTAGES

According to the instant invention, there is provided a boat steering assembly of the type having a pedestal steering actuator in a column mounted on a boat sole and a pair of steering cables leading from the actuator through a substantially vertical orientation and then through a pulley assembly and then in substantially horizontal orientation to a rudder assembly. The steering assembly comprises a depending bracket assembly mounted under the sole, a universal self-adjusting idler pulley means mounted under the pedestal column below the boat sole by the depending bracket assembly, the steering cables extending down from the steering actuator and about the pulley means. The bracket assembly is disposed on the outside of the turn of the cables through the pulley means to suspend the pulley means in tension from the bracket assembly.

An advantage of the subject invention is easier and simpler installation, since the pulley means is self-adjusting to entrain and horizontally route the steering cables to the rudder without painstaking manual adjustments thereof, suspending the pulley means in tension from the bracket assembly during installation of the steering system; moreover, where the cables are crossed in the pedestal, there is automatic adjustment of the pulley means to adjust to small changes in the vertical angle of the cable leading downwardly into the pulley depending on the rudder position.

Another advantage of the subject invention is that self-alignment of the pulley means with the entrance and exit angles of the cable avoids chafing of the entrained cables within the pulley means.

A further advantage of the subject invention is that a loose or slackened cable is held captive by the sheave bracket and cannot jump off the sheave.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
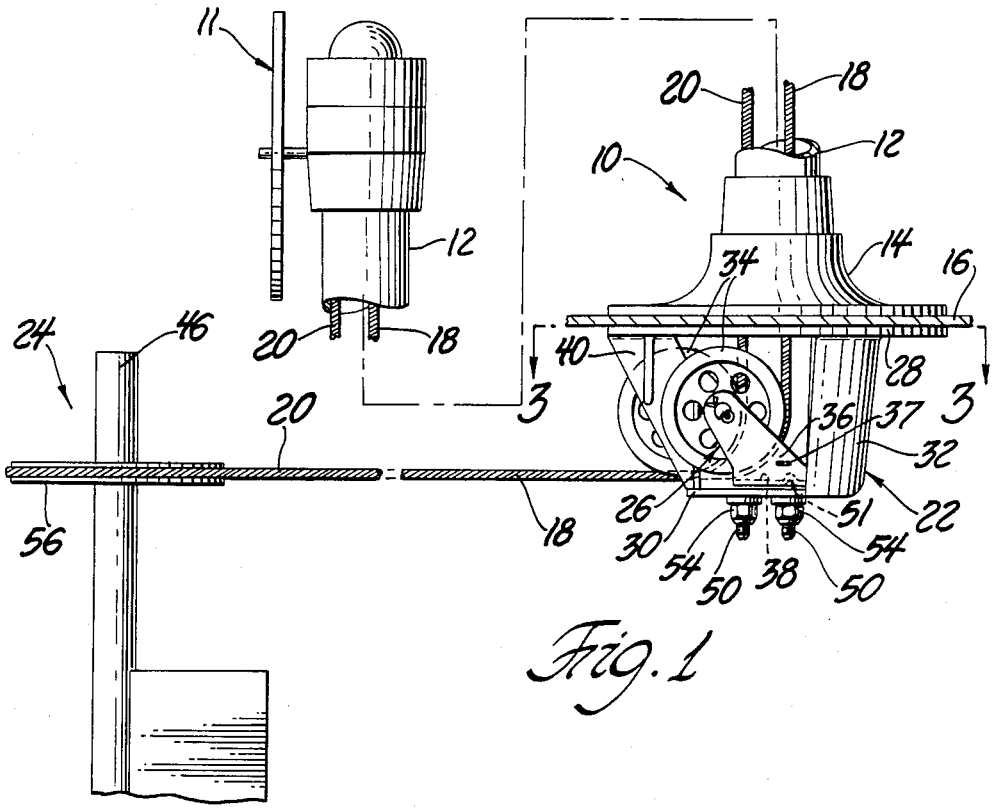
FIG. 1 is a side-elevational view of a preferred embodiment of the invention.

According to the instant invention, there is provided a boat steering assembly, generally shown at 10, of the type having a pedestal steering actuator 11, for instance, a steering wheel operatively connected to a sprocket or the like such as is commonly known in the art. A pedestal column 12 is mounted by a base 14 on a boat sole 16 and a pair of steering cables 18,20 lead from their entrainment about the actuator through a substantially vertical orientation and then through a sheave bracket assembly, generally indicated at 22, and then in substantially horizontal orientation to a rudder assembly, generally shown at 24.

The downwardly depending sheave bracket assembly is mounted under the boat sole 16. A universal self-adjusting idler pulley, generally indicated at 26, is mounted under the pedestal column 12 below the boat sole 16 by said sheave bracket assembly 22. The steering cables 18,20 extend downwardly within the pedestal column 12 from the steering actuator 11 and about the pulley means 26. The bracket assembly 22 is disposed on the outside of the turn of said cables 18,20 which pass through the pulley means 26 to suspend the pulley means in tension from the bracket assembly.

The bracket assembly 22 includes a housing having a flange 28 for engaging the sole 16 of the boat and a mounting plate 30 spaced from said flange 28 and suspended therefrom by a connecting wall 32, the pulley means 26 being attached to the mounting plate 30 in the manner set forth below.

The pulley means 26 includes a pair of pulley wheels 34 and a pair of support arms 36 supporting each of the pulley wheels 34 on the mounting plate 30, each of the cables 18,20 being entrained about one of the wheels 34 and between the support arms 36 thereof.

Figure 2:
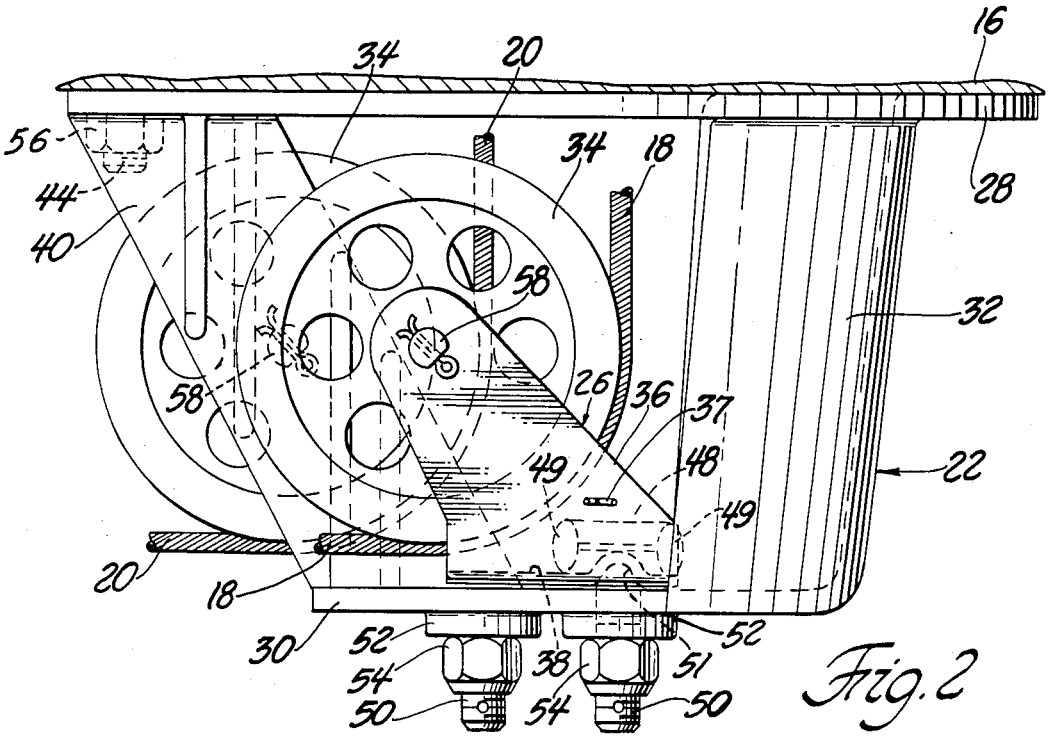
FIG. 2 is an enlarged side-elevational view of the invention.
Figure 3:
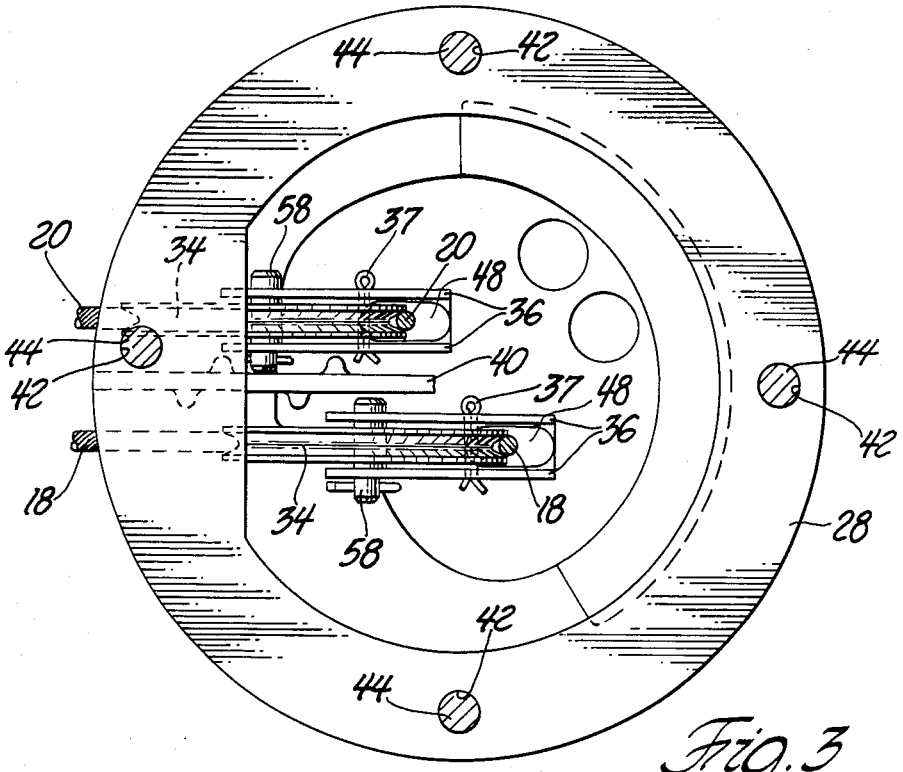
FIG. 3 is a cross-sectional view taken substantially along lines 3—3 of FIG. 1.
Figure 4:
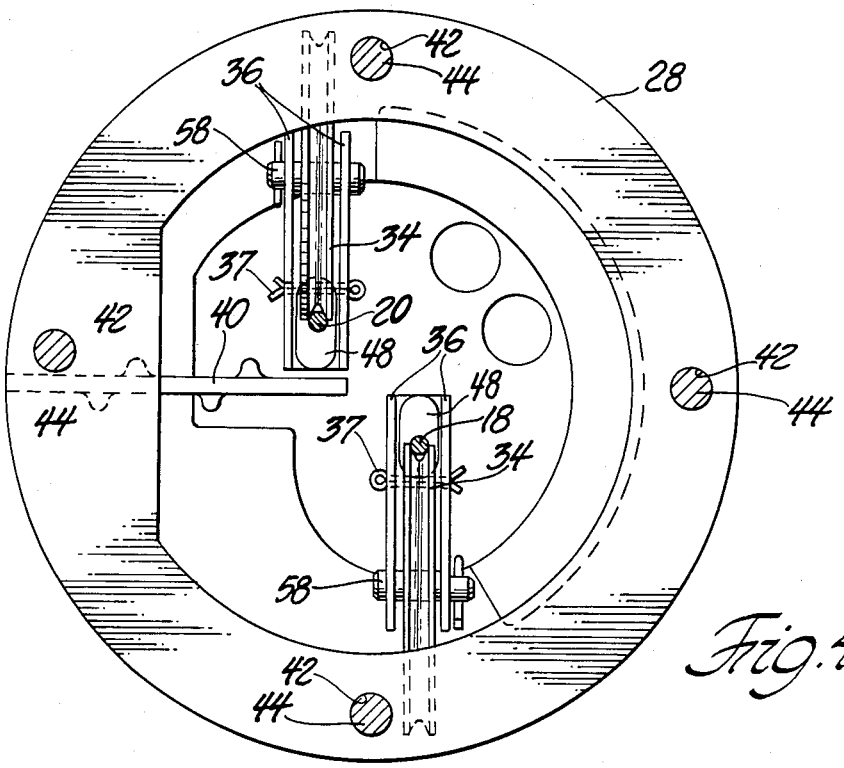
FIG. 4 is a sequential view similar to FIG. 3, but showing a different swivel position of the pulley means.

Each of the pair of support arms 36 is interconnected by a base 38 swivelly mounted about a vertical axis, making the pulleys 26 self-aligning to route the cables at the precise angle toward the rudder. The base 38 is U-shaped and interconnects the support arms 36. As shown in FIGS. 1 through 3, pulley wheels 34 and support arms 36 therefor are offset horizontally from one another in the direction the cables 18,20 extend therefrom. The connecting wall 32 extends about a portion of the extremity of mounting plate 30 to partially surround the pulley means 26. A rib 40 extends between the mounting plate 30 and the flange 28 opposite the connecting wall 32. A plurality of spaced openings 42 are formed in the flange 28 adjacent the rib 40 and in the boat sole 16 and in the base 14 of the pedestal column to receive pedestal mounting bolts 44 therethrough. The openings 42 in the base and boat sole are arrayed in a rectangular pattern about the central axis of the pedestal column 12. The flange 28 includes a corresponding pattern beginning at the rib 40. The mounting bolts 44 should not extend downwardly from the boat sole 16 or they will interfere with the pulley wheels 34. The bolt hole alignment pattern allows the bracket 22 to be loosened by removing the nuts 56 and then rotated about the central axis of the pedestal column to align the rib 40 as closely as possible with the rudder shaft 46 while the openings 42 in the base 14 and boat sole 16 remain in registration with one another vis-a-vis the pedestal mounting bolt 44. The base 38 is attached to the mounting plate 30 for rotation about a vertical axis to allow adjustment of the plane of each pulley wheel 34 to the direction the cable extends therefrom. Regardless of the position or orientation of the rudder shaft 46 relative to the pedestal column, the rotatable bracket and self-aligning pulley will lead the cables to any rudder position without a blind spot to which the cables cannot be run. Simple tensioning of the cables will cause the sheaves to self-align in all three planes thus eliminating all chafing on the sheave, a major cause of internal system function and eventual system failure.

Prior art sheave designs cannot be adjusted to accommodate slight changes in the vertical angle caused by the wire being crossed in the pedestal column as in the case with "disk or radial" drive rudder assemblies. It should be noted that as the wire exits the sheave in a horizontal plane traveling towards the rudder post the vertical angle required will vary depending upon whether the wire travel is directly aft or athwartship, the angle being approximately 4° in the case of aft run and 0° in an athwartship installation. Prior art idlers with rigid pulley bracket can only be adjusted to align with varied wire exit angles from aft to athwartship and cannot accommodate the above noted change in vertical angle.

Utilizing a T-shaped bolt, the pulley means 26 is capable of self-alignment independently along both a vertical and a horizontal axis. The T-bolt has a head 48 elongated in the direction of the base 38 of the pulley with rounded ends 49 (shown in phantom). A shaft portion 50 projects downwardly through a U-shaped slot 51 in the base 38 and through a corresponding boss 52 in the mounting plate 30 to be secured in place by a nut 54. The base 38 of the pulley is U-shaped to conform to the abutting underside of the bolt head 48, toggling about the axis of the elongated head 48 by the slot 51 and swiveling about the vertical axis of the shaft 50 during installation and operation. The slot 51 enables the pulley means to toggle about the bolt head 48 without interference from the bolt shaft 50. Each of the pulley wheels 34 is rotatably supported between an associated pair of arms 36 by a pin 58.

In installing the bracket assembly, the bracket having extrained cables is first rotated to orient the rib 40 as nearly as possible with the rudder shaft 46, after which the pedestal bolts are seated in the nearest possible openings. The T-bolt allows each of the self-aligning pulley means 26 to swivel and toggle to adjust the plane of the pulley wheel 34 precisely to that of the rudder shaft. No minute manual adjustments of the pulley are required as with a rigidly supported pulley mounted in compression. The cables are connected by stakes or other suitable means (not shown) around the drive disk in a manner known to the art.

Further, sheave brackets of the instant invention, by causing the cables to run between the sheave race and the attachment of the sheave base 38, maintain the cable captive within the pulley means 26. A frequent incidence of failure in prior art idlers has been caused by slack cables jumping off the bracket. A cotter pin 37 extends between the arms 36 between the sheave race and bolt head 48 to maintain the wire captive in the sheave race even when the system cables are loose or slack.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A boat steering assembly (10) of the type having a pedestal steering actuator (11) in a hollow column (12) mounted on a boat sole (16) and a pair of steering cables (18, 20) leading from the actuator (11) through a substantially vertical orientation and then through a pulley assembly (22,26) and then in substantially horizontal orientation to a rudder assembly (24), said steering assembly (10) comprising: a depending bracket assembly (22) mounted under the sole (16), a universal self-adjusting idler pulley means (26) mounted under the pedestal column (12) below the bolt sole (16) by said depending bracket assembly (22) for swiveling and toggling to maintain alignment of the steering cables (18, 20) with the rudder assembly (24) as the steering cables (18, 20) extend down from the steering actuator (11) and about said pulley means (26), said bracket assembly (22) disposed on the outside of the turn of the cables (18, 20) through said pulley means (26) and including a housing having a flange (28) for engaging the boat sole (16) and a mounting plate (30) spaced from said flange (28) and suspended therefrom by a connecting wall (32), said pulley means (26) being universally mounted to said mounting plate (30) to suspend said pulley means (26) in tension from said bracket assembly (22) toward said flange (28).

2. A boat steering assembly as set forth in claim 1 further characterized by said pulley means (26) including a pair of pulley wheels (34) and a pair of support arms (36) supporting each of said pulley wheels (34) on said mounting plate (30), each of the cables (18,20) being entrained about one of said wheels and between said support arms thereof.

3. A boat steering assembly as set forth in claim 2 further characterized by each pair of said support arms (36) being interconnected by a base (38), said base (38) being attached to said mounting plate (30) for rotation about a vertical axis to allow adjustment of the plane of each pulley wheel (34) to the direction the cable extends therefrom.

4. A boat steering assembly as set forth in claim 3 further characterized by said pulley wheels (34) and support arms (36) therefor being offset horizontally from one another in the direction the cables extend therefrom.

5. A boat steering assembly as set forth in claim 4 further characterized by said connecting wall (32) extending about a portion of the extremity of said mounting plate (30) to partially surround said pulley means (26), a rib (40) extending between said mounting plate (30) and said flange (28) at a position spaced from and opposite to said connecting wall (32).

6. A boat steering assembly as set forth in claim 5 further characterized by a plurality of spaced openings (42) in said flange (28) for receiving a plurality of pedestal mounting bolts (44) therethrough, said openings being arrayed in a rectangular pattern beginning at said rib 40.

7. An assembly as set forth in claim 3 further characterized by said base (38) being U-shaped and having a slot formed therein for receiving a shaft (50) from a T-shaped bolt (48,50) having an elongated head (48) seated in said base (38), said slot allowing said pulley means (26) to toggle about the axis of said elongated bolt head (48).

8. An assembly as set forth in claim 2 by a retaining pin (37) extending between each of said pair of arms (36) between the outer race of an associated one of said pulley wheels (34) and said bolt head (48), and maintaining an entrained cable (18,20) captive within said bracket assembly (22) when said cable (18,20) becomes loose or slack.

* * * * *